United States Patent [19]

Puschkarski

[11] Patent Number: 4,802,074

[45] Date of Patent: Jan. 31, 1989

[54] DIRECTIONALLY ADJUSTABLE LOW-VOLTAGE LAMP

[76] Inventor: Theodor Puschkarski, Auhofstrasse 170, A1130 Wien, Austria

[21] Appl. No.: 159,672

[22] Filed: Feb. 24, 1988

[30] Foreign Application Priority Data

Mar. 10, 1987 [DE] Fed. Rep. of Germany ..... 3707645
Oct. 2, 1987 [DE] Fed. Rep. of Germany ..... 3733392

[51] Int. Cl.[4] ..... F21V 19/02

[52] U.S. Cl. ..... 362/287; 362/419; 362/396; 439/11

[58] Field of Search ..... 362/418, 419, 285, 287, 362/288, 396, 629, 430, 427; 439/11, 13, 31, 541, 558

[56] References Cited

U.S. PATENT DOCUMENTS

| | | | |
|---|---|---|---|
| 3,511,985 | 5/1970 | Muscovitch | 362/282 |
| 4,214,688 | 7/1980 | Griffin, Jr. | 362/396 |
| 4,453,204 | 6/1984 | Warshawsky | 362/270 |
| 4,494,177 | 1/1985 | Matthews | 362/396 |
| 4,528,618 | 7/1985 | Bitsch | 362/220 |
| 4,609,979 | 9/1986 | Kristofek | 362/427 |
| 4,652,068 | 3/1987 | Boekholt | 439/11 |

FOREIGN PATENT DOCUMENTS

| | | | |
|---|---|---|---|
| 0458723 | 8/1949 | Canada | 439/13 |
| 2555291 | 5/1985 | France | 362/285 |
| 362143 | 7/1962 | Switzerland | 362/285 |

*Primary Examiner*—Michael Koczo
*Assistant Examiner*—D. M. Cox
*Attorney, Agent, or Firm*—Kerkam, Stowell, Kondracki & Clarke

[57] ABSTRACT

The invention relates a directionally adjustable low-voltage lamp comprising a concave reflector to reflect the light as a cone and having a base with a two-pole plug molded thereon. However, such lamp needs complex holders if it is desired to direct the light coming from the lamp in any desired direction. The object of the invention is to provide a directionally adjustable low-voltage lamp being able to be secured at any desired point on sheeting or boards so that the light cone from the lamp may be adjusted in any desired direction. This object is attained by that, that the holder of the lamp is made of two rotary discs which are separated from each other by an insulating disc and are made of electrically conducting material, the central pivot axis of the swivel joint being defined by an axial pin of electrically non-conducting material which is bearinged on the two sides in bearing members of electrically conducting material with a certain degree of axial preloading, and rods of electrically conducting material are secured in these bearing members, such rods being connected with an electrical supply and extending perpendicular to the axia of swivel of the swivel joint and the other ends of such rods being supported in holes in holding members with a frictional engagement so as to be freely rotatable and axially displaceable.

12 Claims, 4 Drawing Sheets

DIRECTIONALLY ADJUSTABLE LOW-VOLTAGE LAMP

The invention relates a directionally adjustable low-voltage lamp comprising a concave reflector to reflect the light as a cone.

Low-voltage lamps have been proposed which reflect the cold light of a halogen bulb with a rating of 50W and 12 volts. Such halogen bulbs provide a bright light which is free of any substantial heating effect.

However, such previously proposed lamps do have the disadvantage that complex holders are needed if the lamp is to be freely directed onto any desired parts of exhibition walls or boarding at any desired point with a sufficient illuminating effect.

The object of the invention is to provide a directionally adjustable low-voltage lamp which remedies the shortcomings of lamps proposed so far, the lamp being able to be secured at any desired point on sheeting or boards or boarding used for exhibition purposes and erected in the form of portable screens held by fastening elements or attached to tubes so that simple adjustment in height and direction is possible in such a manner that the light cone from the lamp may be set at the desired distance from the part to be lit and may be directed at any angle of inclination towards such area.

This object is attained by the characterizing features of claim 1, convenient developments thereof being defined by the characterizing parts of the claims.

The proposed design makes it possible to rapidly, conveniently and simply attach the lamp at any desired position on the boards or tubes supporting same, the cone of light being able to be set at any time at the desired distance from the area to be lit and at any desired angle in order to be able to illuminate certain parts of the boards in the desired manner.

It is more especially an advantage that the concave reflector may be gripped with a single movement of the hand on the insulating disk which does heat up and is provided with grooves so that the light cone may be adjusted through an angle of up to 300° without there being any danger of the person setting the lamp burning his or her fingers and without there being any interuption of the electrical connection between the lamp and the current supply.

It is also an advantage that pins carrying the bulb, which are only held by the frictional engagement in holes in a holding member, may be shortened or extended in length simply by axially pushing them into the drilled holes in the holding member as may be desired so that the lamp may be moved close to the areas to be illuminated and it becomes possible to set the light cone coming from the bulb in a lateral direction as may be desired.

It is furthermore an advantage that the lamp may be used at any desired position on boarding used for advertising purposes or on a tube holding such boarding and that in both these cases one and the same screw clamp may be used, since on attachment of the same to the tube the screw clamp may be directly clamped onto the tube, and in the case of attachment to boarding on the tube the attachment may be undertaken with one and the same half of the clamp jaw.

Since the turnpin of the central turning joint is able to be manufactured of metallic material there is the advantage that it is possible for such pin to be produced in an economic manner with the necessary axial preloading effect of the joint parts, the necessary electrical insulating effect for the current conducting parts being ensured at the same time so that there is a surprisingly simple structure of the attachment parts.

The drawings show a number of different working examples of the invention.

Figures 1, 2:
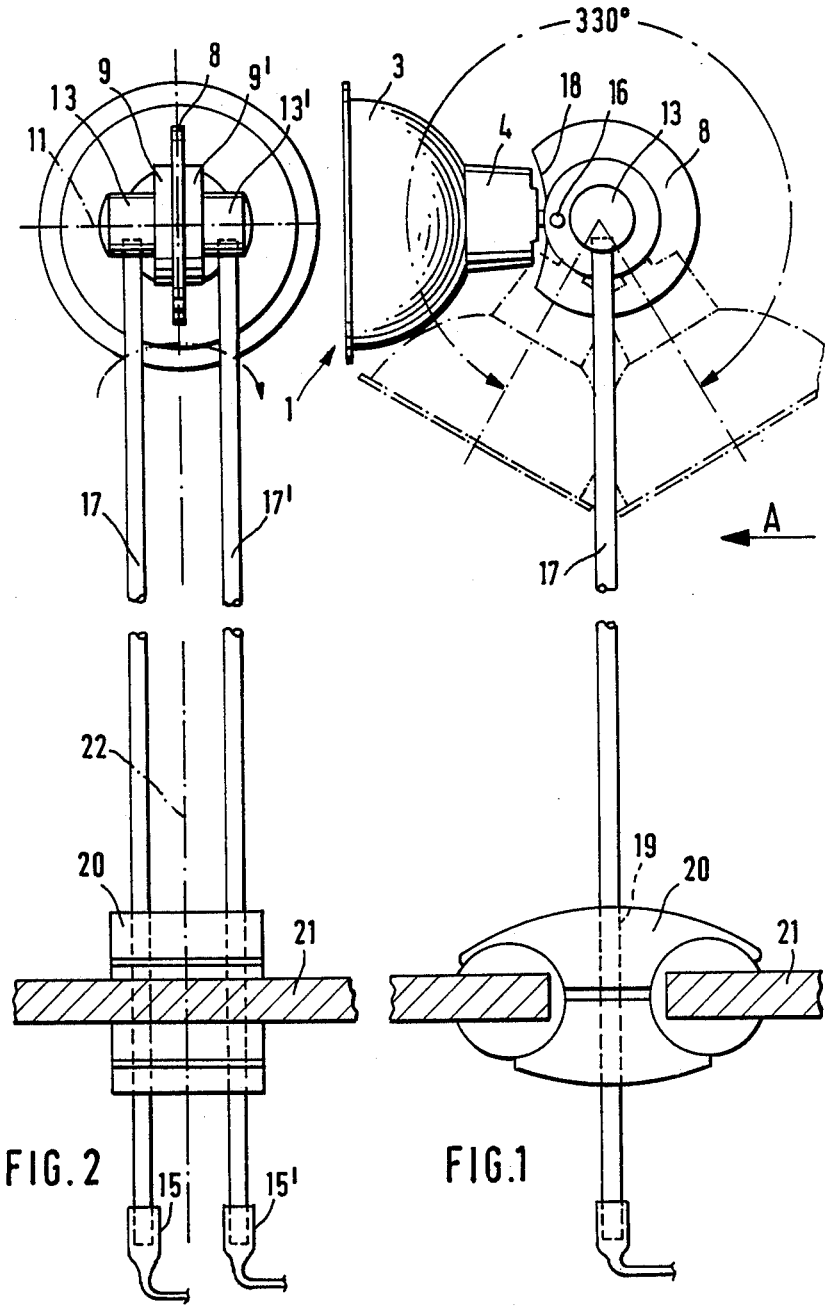
FIG. 1 is a side view of the lamp secured in the swivel joint.
FIG. 2 is a view at a different angle looking in the direction "A" marked in FIG. 1.

The lamp 1 has a concave reflector 3 at whose focus there is a 50W, 12 volt halogen bulb 2. At the base 4 of the concave reflector 3 there is a two-pole plug 5 for the power supply.

The lamp is attached to a swivel joint 7 carried by a holder.

This swivel joint consists of two rotary disks 9 and 9' separated by an insulating disk 8 or washer and made of electrically conducting material, the central swivel axis 11 of the swivel joint 7 being defined by a axial pin 12 of electrically non-conducting material, such pin being mounted on both sides in bearing members 13 of electrically conducting material with a certain degree of axial clamping effect or preloading.

The amount of such axial preloading of the axial pin 12 is so selected that on the one hand there is a sufficient degree of frictional entraining effect between the insulating disk 8 and the rotary disks 9 and 9' on its two sides while on the other hand there is a free rotatability of the rotary disks, which thus form a unit with the insulating disk, in relation to the stationary bearing members 13 arranged on both sides while at the same time ensuring electrical contact between the same.

Furthermore after turning the lamp 1 or after setting it in position it is possible for the lamp to be held in the desired position by the frictional clampig effect.

Figure 6:
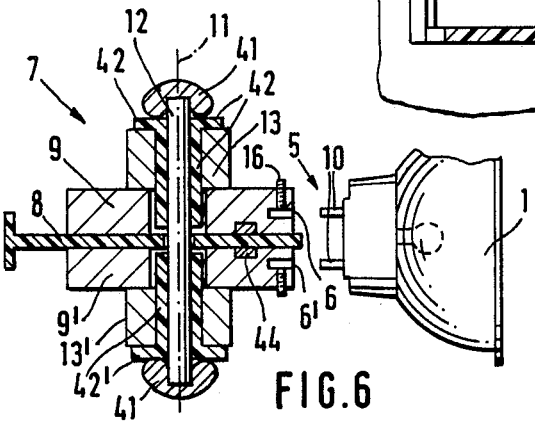
FIG. 6 shows a different working example of the swivel joint in the section as taken on the line V—V of FIG. 3.

It is furthermore possible for the axial pin 12 and the end caps 41 thereof to be manufactured as indicated in FIG. 6 using electrically conducting material, in which respect both the axial pin 12 and also the inner radial faces of the end caps 41 are encased in a sheath of electrically non-conducting material.

Figures 3, 4, 5:
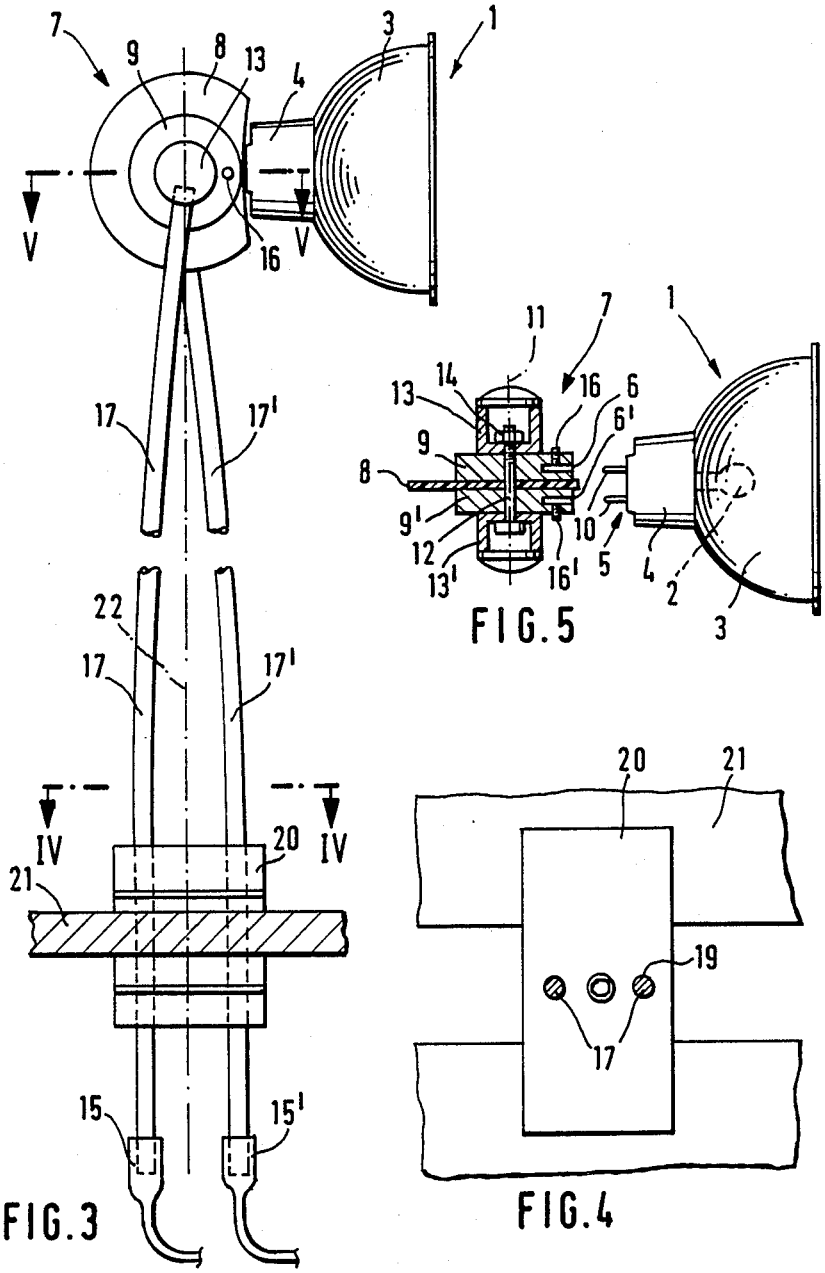
FIG. 3 is a similar view to that of FIG. 2 in which however the pins carrying the swivel joint with the lamp are able to be turned around the central longitudinal axis of same by hand with a torsional twisting effect in order to change the direction of the light cone from the reflector of the lamp.
FIG. 4 is a plane view of the holding member in with sectioning on the line IV—IV of FIG. 3.
FIG. 5 is a section taken on the line V—V of FIG. 3 through the swivel joint with a separate showing of the concave reflector.

The axial preloading for the axial pin 12 may, in accordance with a first working example (see FIG. 5) of the invention, be produced by nuts 14 axially supported in the bearing members 13 and 13'.

In the peripheral surfaces near the ends of each of the two rotary disks 9 and 9', which are separated by an insulating disk 8 and which consist of electrically conducting material, there are drilled socket holes 6 and 6' to receive the plug pins 10 and 10' of the two-pole plug 5 of the base 4 of the lamp 1 in order to ensure the supply of power. These holes 6 and 6' are such that owing to the use of the axial pin 12 consisting of a non-conducting material and owing to the use of the insulating disk 8 for each plug pin 10 and 10' there is a separate current conductor through the swivel joint 7 and via the bearing members 13 and 13' and via rods 17 and 17' of electrically conducting material screwed into such members 13 and 13' and the plug sleeves 15 and 15' to the power supply. The current conducting rods 17 and 17' do not have to be insulated, since the voltage employed of 12 volts would not present any danger to the user of the lamp.

Using the plug pins 10 and 10' of the two-pole plug 5 the lamp 1 is plugged into the plug socket holes 6 and 6' arranged in the end faces of the rotary disk 9 and 9'. In order to ensure both a firm mount of the lamp 1 in the swivel joint 7 and also to guarantee supply of power to the halogen bulb 2 without sparking, there are threaded holes extending to the plug socket holes 6 and 6' in the rotary disks 9 and 9' and allen key screws 16 are so screwed into the holes that the plug pins 10 and 10' of the lamp 1 are so firmly clamped that the lamp is not able to fall out of the holder formed in this manner.

The insulating disk 8 has a larger diameter than the rotary disks 9 and 9' placed on its two sides, the two faces of the insulating disk 8 and also the side faces of the two rotary disks 9 and 9' turned towards the insulating disk being provided with a frictional coating ensuring that a twisting moment is transmitted. The peripheral surface near the side face of each insulating disk is made with grooves so that the person using the lamp is able to readily grasp the insulating disk 8 and to cause a piivoting motion with the rotary disks 9 and 9' with the frictional entraining action and in common with the lamp 1 so the light cone may be turned in desired direction and shone onto any desired area, the arrangement being such that on pivoting this unit an electrical contact is formed between each plug pin 10 and 10' of the two-pole plug 5 of the lamp 1 and the bearing members 13 and 13', which are not entrained, and via the bearing members and the rods 17 and the banana plug 15 to the power supply. The fact that a pivoting of the lamp is possible by grasping the insulating disk 8 means that turning of the lamp is possible without the user of the lamp having to grasp any overheated parts.

In order to be able to freely introduce the two-pole plug 5 of the base 4 of the lamp 1 into the socket holes 6 and 6' in the rotary disk 9 and 9' of the swivel joint 7, the insulating disk 8 has segment-like recess 18 here.

Such a manner of mounting the lamp 1 in the swivel joint 7 means that the lamp and thus the light cone coming from its concave reflector 3 may be swiveled through an angle of 330°, such swiveling action being only slightly less than 360° owing to abutments on the concave reflector so that the light cone may be pointed in almost any desired direction.

The two rods 17 with the ends of the lamp 1 remote from the same are able to be freely turned in the holes 19 in a holding member 20 in which they are held by friction and they are able to freely slide axially. The holding member 20 is preferably in the form of a fastening element in which the holes 19 are placed so that the rods 17 are held in the later with frictional engagement. If the distance between lamp and the board 21 held by the fastening element 20 is to be reduced, it is only necessary to slide the lamp together with the pins 19 frictionally engaged in the holes 19 in the fastening element 20 downwards.

The two rods 17 and 17 are arranged with a certain distance between them so that on torsionally twisting them together with the swivel joint 7 and the lamp 1 about the longitudinal central axis 22 it is possible for the lamp 1 to be swiveled through 340° without the two rods 17 and 17' conducting the power being able to contact each other. Such a torsional twisting effect is similar to the case of rotation of the human hand on turning the later by twisting the two bones of the lower arm about the axis between them.

It is possible to have fastening elements on the holding member 20 if such element is made of an electrically non-conducting plastic. Such fastening elements 20 may be attached to any desired part of the boards 21.

The device of the invention provides a simple way of ensuring very intense illumination of any desired area of a board with an extremely economic use of power, the pratically universal adjustability of the light cone produced by the concave reflector of the lamp being made possible with simple means.

It is also to be pointd out that such a low-voltage halogen lamp is extremely economic, since with a power rating of 50 watts such a lamp produces an amount of light equal to that of a normal 150 watt bulb, while the amount of heat developed is very much less than is the case of normal incandescent lamps.

The rods 17 are conventionally produced with a length of approximately 60 cm so that if the direction is suitably set the desired area may be illuminated in any way desired, this being more particularly made possible by the fact that the lamp 1 may be pivoted around two mutually separate axes which are perpendicular to each other, that is to say by turning around the rotational axis 11 of the swivel joint 7 and by torsional twisting of the rods 17 and 17' around the longitudinal axis 22 the maximum amount of twisting is 340°.

Figure 7:
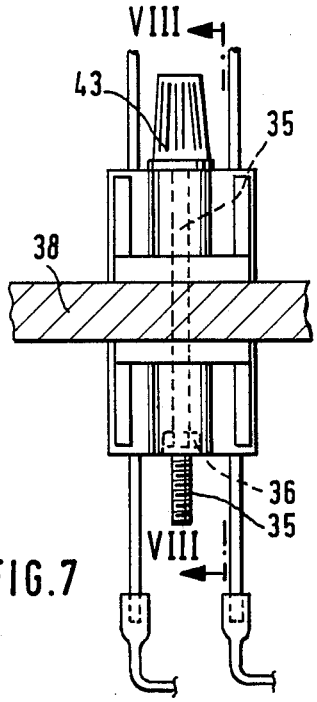
FIG. 7 shows a different embodiment of the invention in the form of a lamp secured in the swivel joint, its holding pins being placed in holes in a screw clamp able to be fixed to a board, looking in the direction "B" of FIG. 8.
Figure 8:
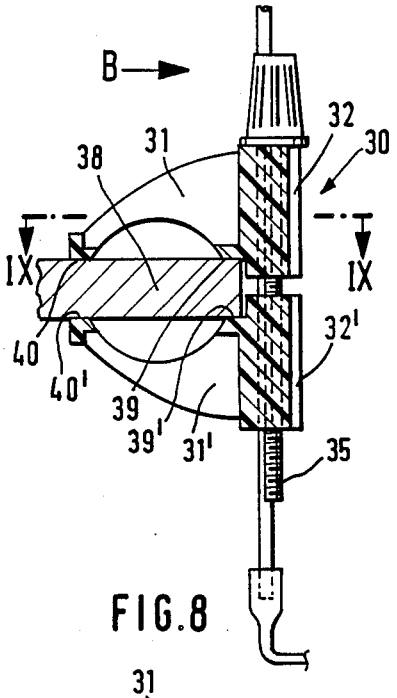
FIG. 8 is a section through the screw clamp taken on the line VIII—VIII of FIG. 7.
Figure 9:
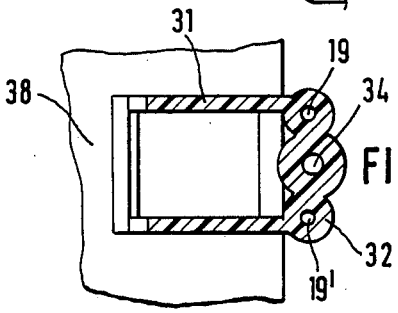
FIG. 9 is a section taken on the line IX—IX of FIG. 8.

If the holding member carrying the lamp 1 is to be secured to any desired point on a board, it is designed in the form of a screw clamp 30 (see FIGS. 7, 8 and 9) which consists of two clamping jaw halves 31 and 31' each projecting in a cantilever fashion from a molded on sliding sleeve 32 and 32' and made of non-conducting material.

The sleeve 32 and 32' is provided with two holes 19 and 19' (see FIG. 9), through which the two electrically conducting rods 17 and 17' (which are electrically insulated from each other) carrying the lamp 1 extend with frictional engagement so that the lamp 1 may be set by hand to be at any desired distance from the screw clamp 30.

Figures 10, 11:
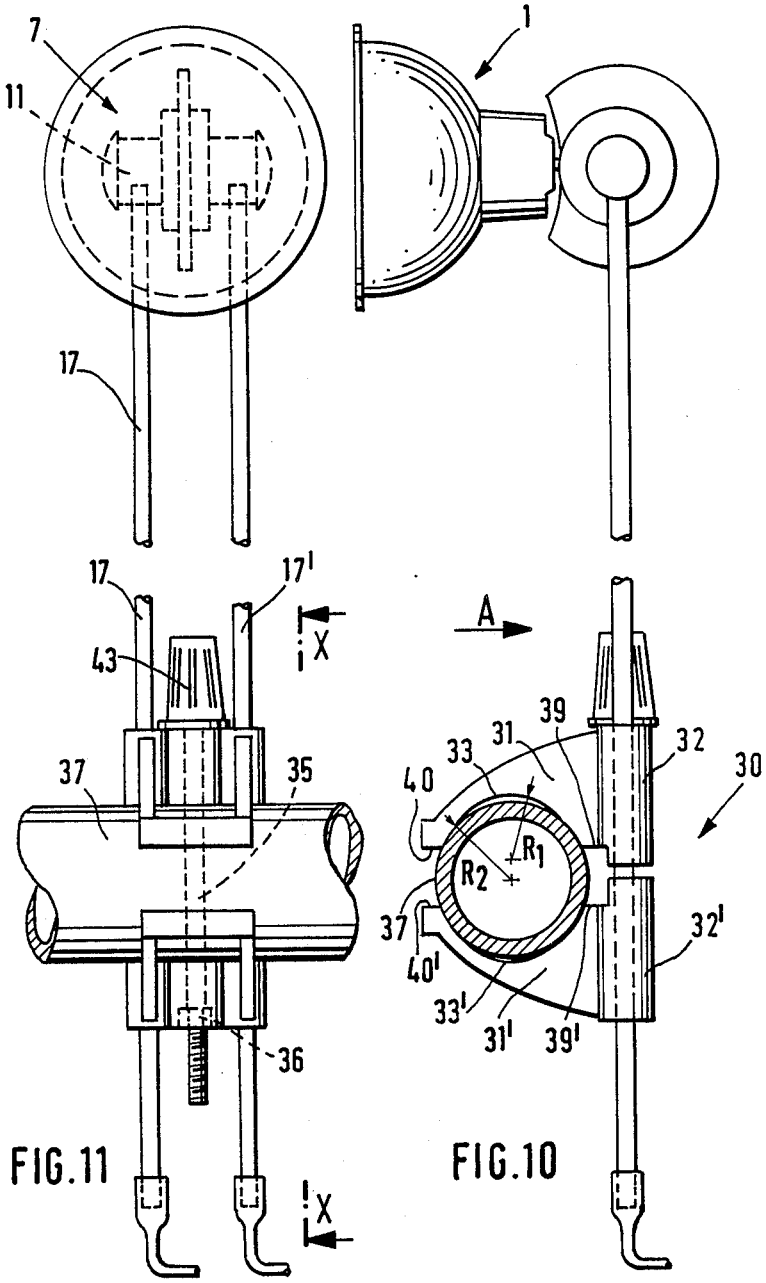
FIG. 10 shows a further working example of the lamp whose holding pins are in drilled holes in a screw clamp secured to a tube.
FIG. 11 is a view looking in the direction "A" of FIG. 10 of the screw clamp secured to a tube.

In the sliding sleeve 32 and 32' of each of the clamping jaw halves 31 and 31' of the adjustable screw clamp 30 there is a third hole 34 (see FIG. 10) extending centrally and parallel to the holes 19 and 19' in order to receive a threaded rod 35 extending freely through the sliding sleeves 32 and 32', and the free end of this rod 35 fits into a nut 36 placed without any possibility of turnig in the sliding sleeve 32' of the lower clamping jaw half 31' (see FIG. 9) and whose upper end screws into a knurled nut 43 bearing on the upper sliding sleeve 32 so that it may be turned by hand.

In order to make it possible for the screw clamp to be attached to a board 38 with any desired thickness, the two clamp jaw halves 31 and 31' have mutually aligned bearer faces 39 and 39' and, respectively 40, 40' both on the ends adjacent to the sliding sleeve 32 and 32' and also on the free end and in a plane extending perpendicularly to the rods 17 and 17''.

If the screw clamp is to be attached to a tube 37 (see FIGS. 10 and 11) the inner faces, forming the bearing sockets 33 and 33', of the screw clamp are made with a curved form whose radius is the same as the radius of the tube so they may fit the two sides of the tubes. In order to attach the screw clamp 30 on a tube 37 the latter is introduced into the bearing socket 33 and 33'. Then the knurled nut 43 is tightened by hand until the halves 31 and 31' of the screw clamp are fitted on the tube 37.

In order to be able to attach the screw clamp to a tube with a different diameter, the bearing socket 33 and 33' is made with a different radius in such a way that the middle part of the latter has a smaller radius $R_1$ than the lateral part with a larger radius $R_2$.

It is in this manner that the screw clamp may grip a tube with a smaller diameter using the middle part of the bearing socket while its lateral parts may be used to grip a tube with a larger diameter.

It is thus possible to use one and the same clamping jaw half 31 and 31' of the clamp 30 for attachment to a tube or a board.

The insulating disk 8 is made with a larger diameter than the rotary disk 9 and at each of the two side faces of the insulating disk 8 can be fastened a pin 44, extending in a recess in the rotary disk 9, 9' and therefore causing a rotary entraining effect.

What is claimed is:

1. A directionally adjustable low-voltage lamp with a concave reflector designed to provide a cone of light and characterized in that the lamp has a holder made up of two rotary disks (9 and 9') which are separated from each other by an insulating disk (8), said two rotary disks made of electrically conducting material, said holder further comprising a swivel joint (7) having a central pivot axis (11) being defined by an axial pin (12) of electrically non-conducting material which is born at opposite ends in bearing members (13 and 13') of electrically conducting material with a certain degree of axial preloading, and rods (17) of electrically conducting material secured in said bearing members (13 and 13'), said rods being connected with an electrical supply and extending perpendicularly to the axis (11) of swivel of the swivel joint (7) and having ends of said rods being supported in holes (19) in holding membranes (20) with a frictional engagement so as to be freely rotatable and axially displaceable.

2. The directionally adjustable low-voltage lamp as claimed in claim 1 characterized in that the axial pin (12) defining the central axis of turning of the swivel joint (7) and its end caps (41) ensuring the preload thereof and bearing against the bearing members (13 and 13') are made of electrically conducting material and both the axial pin (12) and also the inner radial faces of the end caps (41) are encased with a sheath (42) of electrically non-conducting material.

3. A directionally adjustable low-voltage lamp as claimed in claim 1 characterized in that the level of axial preload of the axial pin (12) is so selected that on the one hand there is a sufficient frictional entrainment of the insulating disk (8) with the rotary disks (9 and 9') arranged on both its sides and on the other hand there is a free rotatability of the rotary disks (9 and 9') so forming a unit with the insulating disk (8) in relation to the stationary bearing members (13 and 13') arranged on both sides while ensuring electrical contact between these parts.

4. A directionally adjustable low-voltage lamp as claimed in any one of claims 1, 2 and 3 characterized in that the insulating disk (8) is made with a larger diameter than the rotary disk (9) and that at each of the two side faces of the insulating disk (8) is fastened a pin, extending in a recess in the rotary disk (9,9') and therefore causing a rotary entraining effect.

5. A directionally adjustable low-voltage lamp as claimed in any one of claims 1, 2, and 3 characterized in that the lamp (1) is able to be swiveled through approximately 330° in the rotary joint (7).

6. A directionally adjustable low-voltage lamp as claimed in any one of claims 1, 2, and 3 characterized in that the two rods (17 and 17') extend parallel to each other and are arranged with a certain distance between them so that together with the lamp (1) they make possible a torsional twist about their longitudinal central axis (22) through approximately 340° without the two rods (17 and 17') coming into contact with each other when this takes place.

7. A directionally adjustable low-voltage lamp as claimed in claimed 1 characterized in that the holding member forms an adjustable screw clamp (30), which consists of two clamping jaw halves (31 and 31') extending in a cantilever fashion from a sliding sleeve and facing each other in a symmetrical manner.

8. A directionally adjustable low-voltage lamp as claimed in claim 7 characterized in that the two clamping jaw halves (31 and 31') have bearing sockets (33 and 33') in order to fit onto tubes as segment-like recesses and which in their central part are made with a smaller radius ($R_1$) than the larger radius ($R_2$) of the lateral parts.

9. A directionally adjustable low-voltage lamp as claimed in claim 7 or claim 8 characterized in that the bearing sockets (33 and 33') of the two clamping jaw halves (31 and 31') of the screw clamp (30) both at their end adjacent to the sliding sleeve (32 and 32') and also at their free end form aligned support faces (39, 39' and 40, 40') serving for attachment on a board (38) in a plane running normal to the rods (17 and 17').

10. A directionally adjustable low-voltage lamp as claimed in claim 4 characterized in that the lamp (1) is able to be swiveled through approximately 330° in the rotary joint (7).

11. A directionally adjustable low-voltage lamp as claimed in claim 4 characterized in that the two rods (17 and 17') extend parallel to each other and are arranged with a certain distance between them so that together with the lamp (1) they make possible a torsional twist about their longitudinal central axis (22) through approximately 340° without the two rods (17 and 17') coming into contact with each other when this takes place.

12. A directionally adjustable low-voltage lamp, as claimed in claim 1 characterized in that, that in the peripheral surfaces of each of the two rotary disks 9 and 9′ are drilled socket holes 6 and 6′ to receive the plug pins 10 and 10′ of the two-pole plug 5 of the base 4 of the lamp 1, whereby there are threaded holes extending to the plug socket holes 6 and 6′ in the rotary disks 9 and 9′ and allen key screws 16 are screwed into the holes that the plug pins 10 and 10′ of the lamp 1 are so firmly clamped that the lamp is not able to fall out and the supply of power in ensured.

* * * * *